US005322351A

United States Patent [19]

Lent

[11] Patent Number: 5,322,351

[45] Date of Patent: Jun. 21, 1994

[54] ROTARY CUTTER AND MOUNTING ARRANGEMENT FOR CUTTING TOOLS

[75] Inventor: Kevin C. Lent, Rogers, Minn.

[73] Assignee: Caterpillar Paving Products Inc., Minneapolis, Minn.

[21] Appl. No.: 65,728

[22] Filed: May 24, 1993

[51] Int. Cl.[5] ..... E21C 35/18

[52] U.S. Cl. ..... 299/87; 299/93

[58] Field of Search ..... 299/87, 91, 93

[56] References Cited

U.S. PATENT DOCUMENTS

| | | | |
|---|---|---|---|
| 3,614,164 | 10/1971 | Davis | 299/83 |
| 3,749,449 | 7/1973 | Krekeler | 299/93 |
| 4,057,294 | 11/1977 | Krekeler | 299/93 |
| 4,275,929 | 6/1981 | Krekler | 299/91 |
| 4,371,210 | 2/1983 | Leibee | 299/10 |
| 4,415,208 | 11/1983 | Goyarts | 299/91 |
| 4,713,897 | 12/1987 | Hemphill | 299/91 X |
| 5,078,540 | 1/1992 | Jakob et al. | 404/90 |

FOREIGN PATENT DOCUMENTS

| | | |
|---|---|---|
| 3611446 | 10/1987 | Fed. Rep. of Germany . |
| 2644992 | 12/1987 | Fed. Rep. of Germany . |
| 2230289 | 10/1990 | United Kingdom . |

*Primary Examiner*—David J. Bagnell

*Attorney, Agent, or Firm*—Robert A. McFall

[57] ABSTRACT

A rotary cutter having a plurality of flighting segments which have a tool holder receiving pocket extending radially inwardly from an outer surface of the flighting segments. Cutting tool holders are retained in the pocket by a wedge disposed adjacent the trailing edge of the tool holder and a bolt extending radially inwardly toward a longitudinal axis of the rotary cutter. The bolt extends through the wedge and an opening in the flighting segment and engages a nut disposed in a passageway extending transversely through the flighting segment.

3 Claims, 3 Drawing Sheets

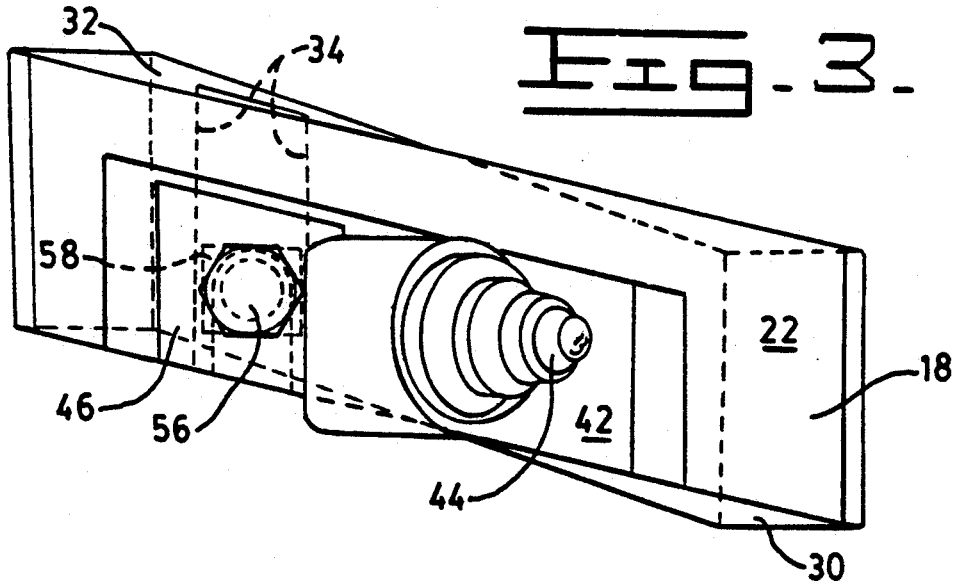
Fig. 3.
Fig. 4.
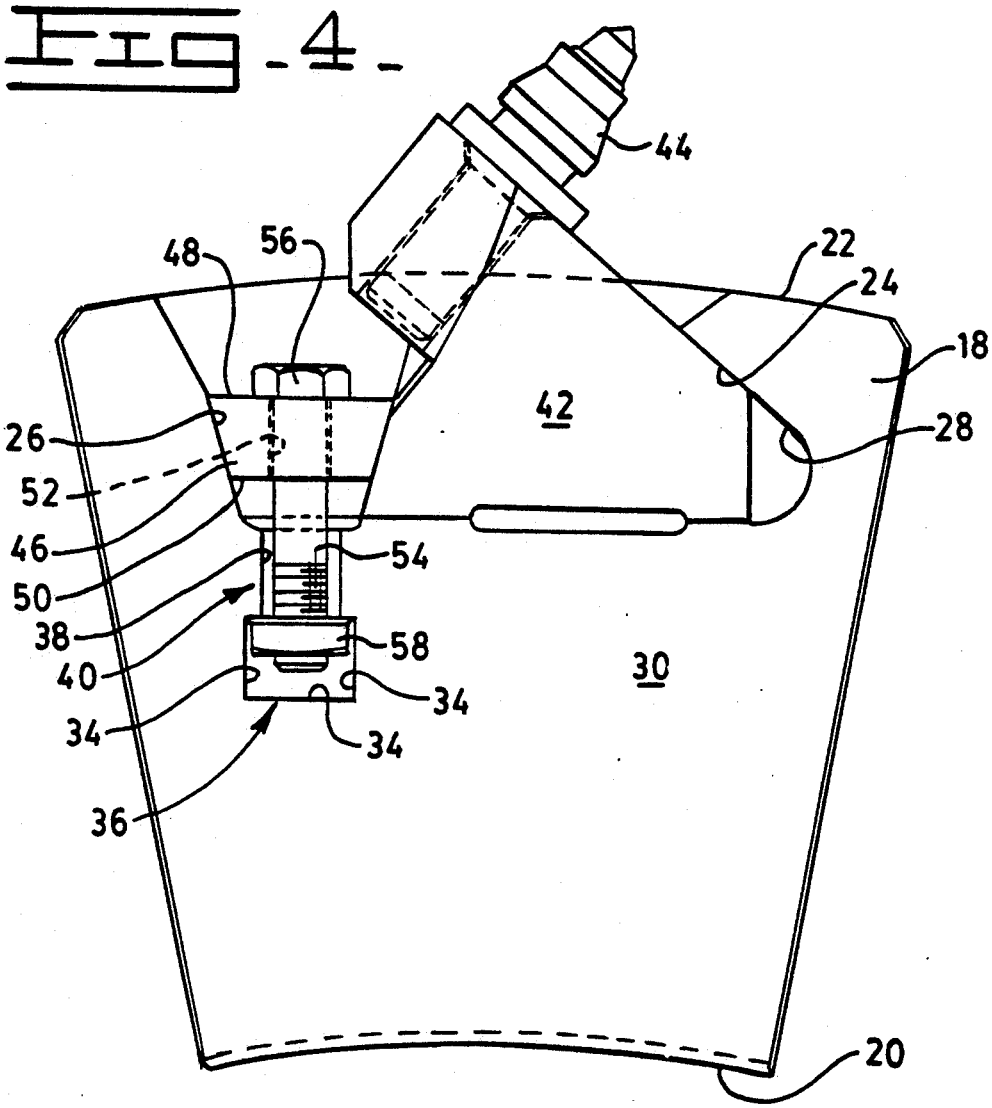

ROTARY CUTTER AND MOUNTING ARRANGEMENT FOR CUTTING TOOLS

TECHNICAL FIELD

This invention relates generally to a rotary cutter, and more particularly to a rotary cutter having a plurality of cutting tools circumferentially disposed about, and in spaced relationship from, the surface of a rotating drum.

BACKGROUND ART

Rotary cutters of the type used on roadway planers, also known as pavement profilers, road milling machines or cold planers, and on road reclaiming or scarifying machines, are well known in the art. An example of such rotary cutters is disclosed in British Patent Application No. 2,230,289A, published Oct. 17, 1990. The British publication discloses a rotary cutter having a plurality of cutting tools mounted in tool holders that are bolted to the flighting forming a spiral conveyor about the surface of a rotatable drum. The tool holders are secured to the flighting by screws that are threaded into threaded holes in the body of the tool holder. Other prior art arrangements secure the tool holders by screws, or bolts, threaded into holes provided in the drum surface or by welding the tool holder to the drum surface.

Tool holder mounting arrangements that require threaded holes in either the tool holder, drum surface or other fixture secured to the drum surface, are prone to thread damage. Overtightening of the screw member can strip the threads in the threaded hole. Impact forces acting on the cutting tool during operation of the rotary cutter can also damage the threaded connection. When such damage occurs, it is extremely difficult to remove the tool holder when replacement is required due to wear, breakage, or other damage. If threads disposed in the drum surface, or in a member permanently attached to the drum surface are damaged, the threads must be repaired by boring and cutting oversized threads or installing a threaded insert. Furthermore, the head end of the securing bolts or screws are often exposed to contact with the cut material, resulting in abrasive wear which further exacerbates the problem of removal and repair.

The present invention is directed to overcoming the problems set forth above. It is desirable to have a mounting arrangement for cutting tools on a rotary cutter wherein threaded holes are not required in either the tool holder or base member in which the tool holder is mounted. It is also desirable to have such as mounting arrangement in which the ends of the securing bolts are shielded from abrasive wear. Further, it is desirable to have a rotary cutter in which the tool holders are removably mounted in a recess provided in the radially outer surface of screw conveyor flighting comprising a plurality of replaceable segment members.

DISCLOSURE OF THE INVENTION

In accordance with one aspect of the present invention, a rotary cutter includes a rotatable drum having a plurality of flighting segment members that are attachable to an outer surface of the drum. The flighting segment members have inner and outer radially spaced wall surfaces, and a pair of divergent wall surfaces extending radially inwardly from the outer wall surface and defining a portion of a tool holder receiving pocket.

The flighting segment members also have a pair of side walls extending from the inner to the outer wall surface with at least one of the side walls defining a material conveying surface, and a plurality of transverse wall surfaces extending between the sidewalls and defining a passageway through the flighting segment member. Also, a wall surface defines an opening extending radially inwardly from the tool holder receiving pocket and extends to the transversely disposed passageway. A tool holder is disposed in the tool holder receiving pocket in an abutting relationship with one of the divergent wall surfaces. A wedge is interposed the tool holder and the other one of the divergent wall surfaces and has a bore extending through the wedge between upper and lower surfaces of the wedge. An adjustable screw having a nut threadably attached at one end extends through the wedge bore and the radially inwardly extending opening in the flighting segment member.

BRIEF DESCRIPTION OF THE DRAWINGS

FIG. 3 is a top view of the assembly shown in FIG. 2 and,

FIG. 4 is a side view of the assembly shown in FIG. 2.

BEST MODE FOR CARRYING OUT THE INVENTION

Figure 1:
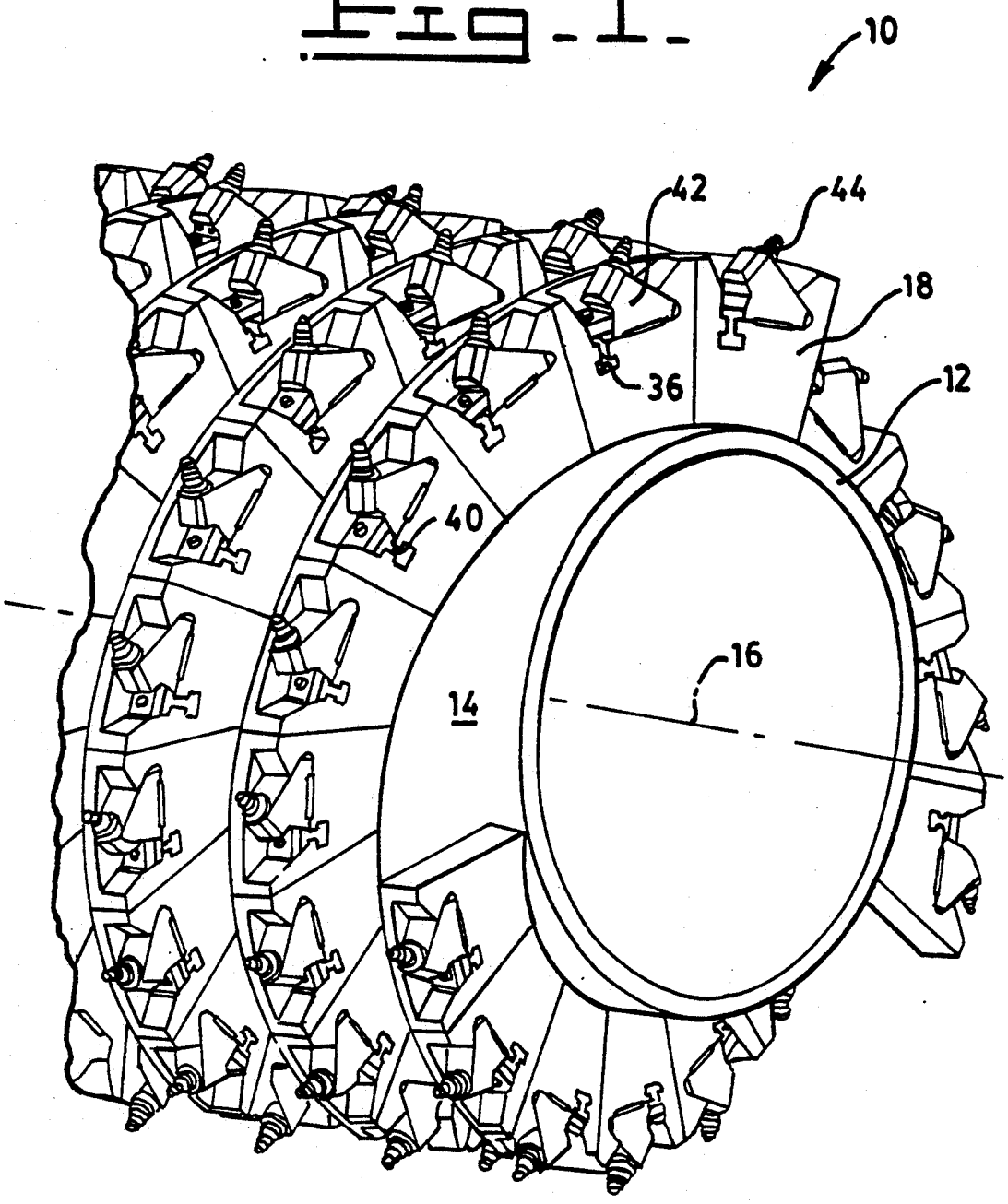
FIG. 1 is a perspective view of a portion of a rotary cutter embodying the present invention.

A shortened section of a rotary cutter 10 of the type suitable for use on roadway milling, planing or reclamation machines, is shown in FIG. 1. Conventionally, the rotary cutter 10 includes a drum 12 having an outer surface 14. The drum 12 is rotatable about a longitudinal axis 16 that is customarily disposed parallel to the ground or roadway surface being cut.

Figure 2:
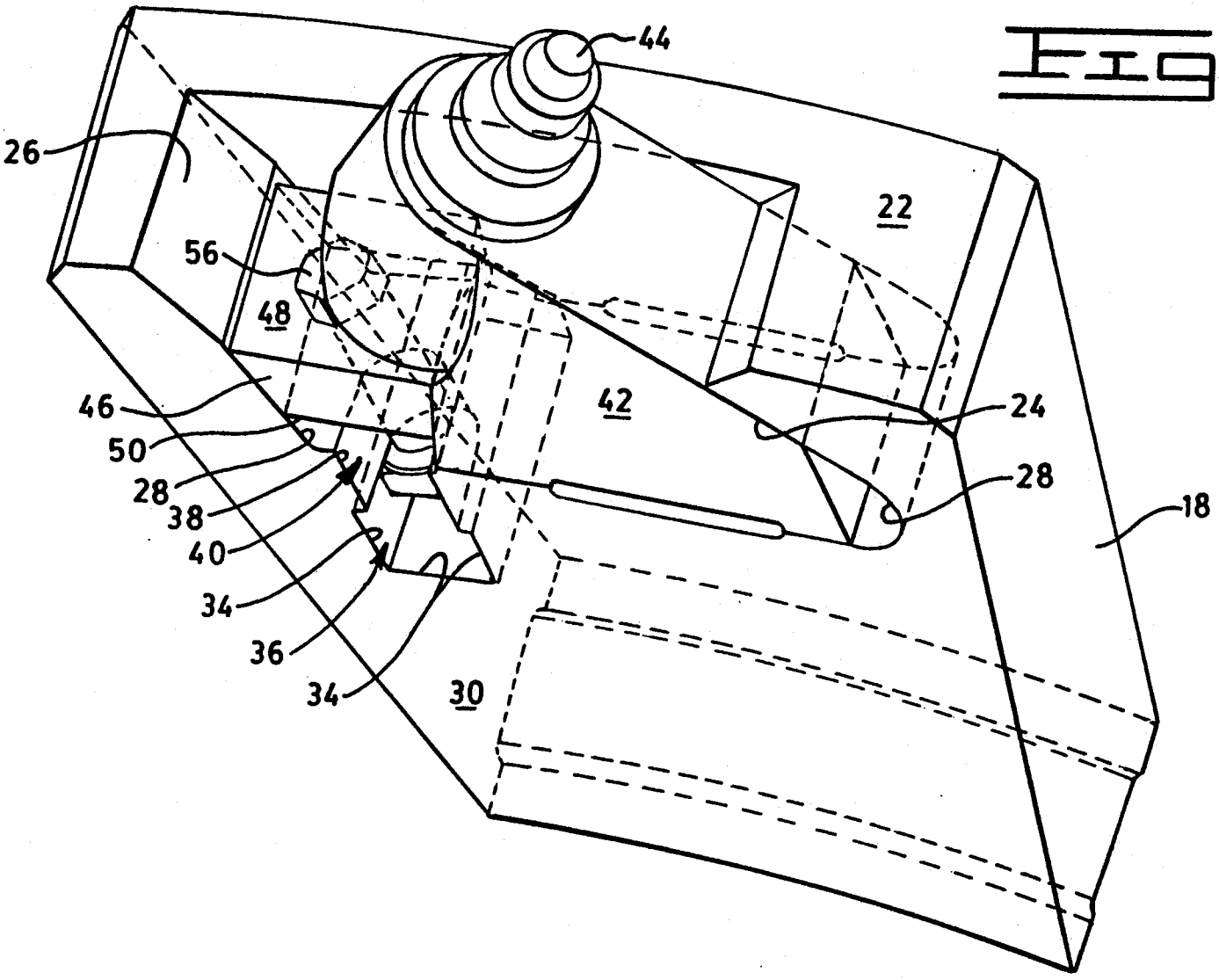
FIG. 2 is perspective view of a flighting segment member showing a cutting tool, tool holder, wedge and adjustable screw member embodying the present invention.

In the preferred embodiment of the present invention, the rotary cutter 10 has a plurality of flighting segment members 18 that are individually attached to the outer surface 14 of the drum 12. As best shown in FIGS. 2, 3 and 4, each of the flighting segment members has an inner wall surface 20 and a radially spaced outer wall surface 22. The inner wall surface 20 is curved to match the curvature of the outer surface 14 of the drum 12. Preferably the inner wall surface 20 is relieved in a center portion to provide better contact at its outer edges with the drum surface whereas the flighting segment member is preferably attached to the drum surface by welding.

In the preferred embodiment of the present invention, each of the flighting segment members 18 have a pair of divergent wall surfaces 24,26 extending radially inwardly from the outer wall surface 22. The divergent wall surfaces 24,26 cooperate to define a portion of an open-sided tool holder receiving pocket 28 in the flighting segment member 18.

Each of the flighting segment members 18 also have a pair of side walls 30,32 that extend radially outwardly from the inner wall surface 20 to the outer wall surface 22. At least one of the side walls, identified as side wall 32 in FIG. 3, forms a material conveying surface for moving cut material in a predetermined direction in response to rotation of the drum 12. In the preferred embodiment of the present invention, the flighting segment members 18 are attached to the outer surface 14 of the drum 12 in an aligned, abutting relationship. The material conveying surfaces 32 thereby provide a substantially continuous surface cooperating with the outer surface 14 of the drum 12 to provide a screw conveyor for moving cut material in a direction along the longitudinal axis 16. As illustrated in FIG. 1, material disposed in the channels formed by the flighting segments and the drum surface will move leftwardly along the axis 16 in response to rotation of the drum in a clockwise direction.

In many machines of the type using the rotary cutter embodying the present invention, a conveyor is carried on the machine to transfer material from a longitudinally central area of the drum. In such arrangements, the flighting segments are desirably arranged to move material from the end areas toward the longitudinal center area of the drum. For example, the flighting segments at the opposite end (left end) of the drum are provided with a pitch opposite to that of the right end so that the cut material is moved in a rightwardly direction toward the center area of the drum.

Each of the flighting segment members 18 also have a plurality of transversely disposed wall surfaces 34 that extend between the pair of side walls 30,32 and define a passageway 36 through the segment member 18. The flighting segment members 18 also have a wall surface 38, part of which is advantageously curved, defining a slotted opening 40 communicating with the side wall 30 and extending radially inwardly from the tool holder receiving pocket 28 to the passageway 36. The passageway 36 and the slotted opening 40 provide access to a nut and lower bolt end, enabling the nut and bolt end to be driven out by a punch, as described below.

A tool holder 42, providing support for a cutting tool 44, is disposed in the tool holder receiving pocket 28. The base portion of the tool holder is shaped to mate with the forwardly disposed divergent wall surface 24 and, when installed, is in forced abutment with the wall surface 24.

The forced abutment of the tool holder 42 against the forward divergent wall surface 24 is provided by the radially inward movement of a wedge member 46 that is positioned between tool holder 42 and the rearwardly disposed divergent wall surface 26. The wedge member 46 has an upper surface 48, a lower surface 50, and a smooth bore 52 extending between the upper and the lower surfaces 48,50.

The wedge member 46 is moved in a radially inward direction in response to tightening an adjustable screw member 54 extending through the smooth bore 52 in the wedge member 46 and the slotted opening 40 in the flighting segment member 18. The adjustable screw member 54 has a head end 56 that is recessed inwardly from the outer surface 20 of the flighting segment member. The recessed placement of the wedge 46 and the bolt head 56 provides protection against wear and damage caused by erosion and abrasion of the cut material during operation of the rotary cutter. The wedge and bolt head are further protected by being positioned behind (in the direction of rotation of the drum 12) the tool holder 42.

The adjustable screw member 54 also includes a nut member 58 threadably attached at the end opposite the head 56. As shown in the drawings, the nut member 58 is disposed in the passageway 36 extending through the flighting segment member 18, preferably has a square or rectangular shape, and abuts a shoulder extending outwardly from the slotted opening 40 in the flighting segment member.

In operation, if the tool holder 42 should be broken, damaged or otherwise require replacement, the adjustable screw member 54 can be loosened and the tool holder, wedge and screw member moved laterally. The tool holder and wedge member 46 may then be withdrawn through the open side of the receiving pocket 28, the lower end of the adjustable screw member 54 through the slotted opening 40, and the nut member 58 through the passageway 36. If the threaded coupling between the bolt 54 and nut 58 should become frozen, or the threads stripped, the bolt may be cut by directing a thin pencil flame from a cutting torch to the bolt shank through the clearance opening between the lower surface 50 of the wedge 46 and the bottom of the tool holder receiving pocket 28. After cutting, the nut 58 and lower end of the bolt can be driven out by striking the nut with a punch inserted through the passageway from the material conveying side of the flighting segment.

In the preferred embodiment of the present invention as described above, each of the flighting segments 18 have a pocket 28 for receiving a single tool holder 42. Alternatively, each of the flighting segment members 18 may contain multiple tool holder receiving pockets 28.

INDUSTRIAL APPLICABILITY

The rotary cutter 10 embodying the present invention is particularly useful on roadway planers or milling machines and road reclaiming machines. In particular, the fastening arrangement holding the tool holder in place is not subjected to dynamic loads during operation which could cause fatigue failure or loosening of the fastener. Dynamic loads, resulting from the impact forces produced by contact of the cutting tool 44 with material to be cut, will produce a force moment acting in a counterclockwise direction (as viewed in FIG. 4) about the center of gravity of the tool holder. In the present invention, the tool holder fastener, i.e., the adjustable screw member 54, is positioned behind the trailing edge of the tool holder and therefore the dynamic loads imposed on the screw member during operation will not be additive to the preapplied bolt tension.

Furthermore, the primary structural components of the rotary cutter arrangements embodying the present invention, i.e., the flighting segment members 18 and the tool holder 42 are economically formed by casting or forging. If damaged during operation, the flighting may be repaired by replacing only the damaged segment. If a tool holder is damaged during operation it can, as explained above, be readily removed and replaced.

Another important feature of the present invention is provided by recessing the tool holder, and even a portion of the cutting tool itself, radially inwardly from the outer wall surface 20 of the flighting segment member 18. This arrangement advantageously provides more available flighting surface for increased material conveying capacity.

Thus it can be seen that the rotary cutter embodying the present invention provides significant structural, economic, operational and repairability advantages over presently known rotary cutter arrangements.

Other aspects, objects and advantages of this invention can be obtained from a study of the drawings, the disclosure, and the appended claims.

What is claimed is:

1. A rotary cutter comprising:

a drum having an outer surface and being rotatable about a longitudinal axis;

a plurality of flighting segment members each being attachable to said drum surface and having inner and outer radially spaced wall surfaces, a pair of divergent wall surfaces extending radially inwardly from said outer wall surface and defining a portion of a tool holder receiving pocket, a pair of side walls extending radially outwardly from said inner wall surface to said outer wall surface, at least one wall of said pair of side walls defining a material conveying surface, a plurality of transverse wall surfaces extending between said pair of side walls and defining a passageway through said flighting segment member, and a wall surface defining an opening extending radially inwardly from said tool holder receiving pocket and communicating with said passageway;

a tool holder disposed in said tool holder receiving pocket in an abutting relationship with a first one of said pair of divergent wall surfaces;

a wedge member having an upper and a lower surface and a bore extending between said upper and lower surfaces, said wedge member being interposed a second one of said pair of divergent wall surfaces and said tool holder; and, an adjustable screw member having a nut member threadably attached at one end thereof, said screw member extending through the bore in said wedge member and the opening extending radially inwardly in said flighting segment member, and said nut member being disposed in the passageway in said flighting segment member.

2. A rotary cutter, as set forth in claim 1, wherein said flighting segment members are circumferentially disposed on said drum surface in an abutting relationship and the material conveying surface of each of said segment members cooperate with each other and the outer surface of said drum to form a substantially continuous conveyor for moving material in a direction along said longitudinal axis.

3. A rotary cutter, as set forth in claim 1, wherein said adjustable screw member has a head end spaced from said nut member, and said wedge member and said head end of the adjustable screw member are disposed radially inwardly from the outer wall surface of said flighting segment member.

* * * * *